US010774826B2

(12) United States Patent
MacIver et al.

(10) Patent No.: US 10,774,826 B2
(45) Date of Patent: Sep. 15, 2020

(54) INLINE MONITORING PACKAGE FOR AN ELECTRIC SUBMERSIBLE PUMP SYSTEM

(71) Applicant: ZiLift Holdings, Limited, Aberdeen (GB)

(72) Inventors: Ivor MacIver, Aberdeenshire (GB); Edwin Coutts, Stonehaven (GB); Kenneth J. Sears, Suffolk (GB)

(73) Assignee: ZILIFT HOLDINGS, LTD., Aberdeen (GB)

( * ) Notice: Subject to any disclaimer, the term of this patent is extended or adjusted under 35 U.S.C. 154(b) by 208 days.

(21) Appl. No.: 15/864,019

(22) Filed: Jan. 8, 2018

(65) Prior Publication Data

US 2018/0223830 A1 Aug. 9, 2018

Related U.S. Application Data

(60) Provisional application No. 62/454,078, filed on Feb. 3, 2017.

(51) Int. Cl.

| | |
|---|---|
| ***F04D 13/10*** | (2006.01) |
| ***F04B 47/06*** | (2006.01) |
| ***F04B 49/10*** | (2006.01) |
| ***F04B 49/06*** | (2006.01) |
| ***E21B 43/12*** | (2006.01) |

(Continued)

(52) U.S. Cl.

CPC ..... *F04B 47/06* (2013.01); *E21B 43/128* (2013.01); *E21B 47/008* (2020.05); *E21B 47/12* (2013.01); *F04B 17/03* (2013.01); *F04B 49/065* (2013.01); *F04B 49/10* (2013.01); *F04B 51/00* (2013.01); *F04B 53/08* (2013.01); *F04B 53/16* (2013.01); *F04D 13/10* (2013.01); *F04B 2203/021* (2013.01); *F04B 2207/02* (2013.01); *F04D 29/5813* (2013.01)

(58) Field of Classification Search

CPC ..... F04B 47/06; F04D 13/086; F04D 13/10; F04D 25/0686; F04D 29/5813; E21B 47/0007; E21B 43/128

See application file for complete search history.

(56) References Cited

U.S. PATENT DOCUMENTS 5,602,541 A * 2/1997 Comeau ..... E21B 7/04 175/45
5,931,000 A * 8/1999 Turner ..... E21B 36/003 166/66

(Continued)

*Primary Examiner* — Charles G Freay
*Assistant Examiner* — Thomas Fink
(74) *Attorney, Agent, or Firm* — Richard A. Fagin

(57) ABSTRACT

An inline monitoring package for a submersible pumping system includes a housing having a first end for connection to a motor, a pump or a seal section of the pumping system, and a second end for connection to the motor, the pump or the seal section. The housing is disposed between any two of the pump, the motor and the seal section. A shaft transmits rotation from the motor to the pump. The housing comprises a chassis having a through bore and an end plug at each longitudinal end. The through bore has a diameter selected to enable free passage of the shaft and fluid associated with the shaft. The end plugs sealingly engage an interior wall of the housing so as to define a sealed chamber inside the housing and external to the chassis between the end plugs. At least one electronic component is disposed in the sealed chamber.

17 Claims, 5 Drawing Sheets

(51) Int. Cl.

| | |
|---|---|
| ***E21B 47/12*** | (2012.01) |
| ***F04B 53/08*** | (2006.01) |
| ***F04B 51/00*** | (2006.01) |
| ***F04B 17/03*** | (2006.01) |
| ***F04B 53/16*** | (2006.01) |
| ***E21B 47/008*** | (2012.01) |
| *F04D 29/58* | (2006.01) |

(56) References Cited

U.S. PATENT DOCUMENTS

| | | | | |
|---|---|---|---|---|
| 6,012,537 | A * | 1/2000 | Rountree | E21B 4/02 166/242.1 |
| 6,220,346 | B1 * | 4/2001 | Gissler | E21B 36/003 166/57 |
| 7,190,084 | B2 * | 3/2007 | Hall | E21B 41/0085 290/1 R |
| 8,347,953 | B1 * | 1/2013 | Elizondo, Jr. | E21B 47/0007 166/105 |
| 2006/0219401 | A1 * | 10/2006 | Longfield | E21B 47/12 166/250.1 |
| 2013/0272898 | A1 * | 10/2013 | Toh | F04D 13/10 417/44.1 |
| 2016/0248364 | A1 * | 8/2016 | Askeland | F04D 15/0066 |
| 2016/0251956 | A1 * | 9/2016 | Parra | E21B 43/128 340/854.9 |
| 2016/0265289 | A1 * | 9/2016 | Goodman | E21B 19/00 |
| 2016/0319607 | A1 * | 11/2016 | Maclean | E21B 17/003 |
| 2018/0195373 | A1 * | 7/2018 | Bell | F04B 47/06 |

* cited by examiner

INLINE MONITORING PACKAGE FOR AN ELECTRIC SUBMERSIBLE PUMP SYSTEM

CROSS REFERENCE TO RELATED APPLICATIONS

Priority is claimed from U.S. Provisional Application No. 62/454,078 filed on Feb. 3, 2017 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of electric submersible pumps (ESPs) used in subsurface wells. More specifically, the disclosure relates to sensors used in connection with ESPs to monitor motor speed and other functional parameters of the ESP and the ambient environment in the well.

Submersible pumping systems such as ESPs are deployed in wells to recover petroleum fluids from subterranean reservoirs and to remove water from gas wells to enhance productivity, among other uses for such pumping systems. A submersible pumping system such as an ESP may include a number of components, such as a fluid filled electric motor coupled to one or more high performance pumps. "Monitoring packages" (i.e., various forms of sensor assemblies in suitable housings for use in a subsurface well) are used to provide the well operator and an automated control system with real-time information about the performance of the submersible pumping system and the ambient environment in the well.

Different arrangements of a submersible pumping system are possible, including disposing the (electric) motor below the pump, in which case the monitoring package may conveniently be placed below the motor. In other pumping systems, the motor may be disposed above the pump, in which case the monitoring package will be either above the motor (and whereby the motor power cable has to pass the monitoring package), or the monitoring package may be inline, disposed longitudinally between the motor and the pump, in which case the motor shaft has to pass through the monitoring package in order to drive the pump.

Submersible electric motors are known to use three-phase AC power to drive the motor, using one of several wiring configurations known in the art. Such wiring configurations include a wye connection in which three conductors share a common neutral connection. The wye connection may conveniently provide a source of power for the monitoring package using the power lines connected to the electric motor. In this way, a single connection from a surface-located motor control unit can be used to control the speed of and provide electric power to the motor, and to provide electric power to the monitoring package. Power for the monitoring package may be provided as simply as using the common connection of the wye point, such that electrical power may be provided to the monitoring package.

Sensor measurement data from the monitoring package may conveniently be transmitted to surface along the motor power cable, most conveniently by using the common or wye connection from one or more phases of the motor power supply lines.

U.S. Pat. No. 8,347,953 issued to Elizondo et al. explains an inline monitoring package in which the interior of the monitoring package is filled with lubricating oil, and the electronic components of the monitoring package are encapsulated to prevent contact with lubricants within the inline monitoring package. The method of encapsulation is to submerge electronic components into a resin system, for example, an epoxy resin, and allowing the resin to cure. After curing, a thick coating of the resin completely surrounds the components to form an impervious seal from the surrounding conditions. This process is also called "potting."

Monitoring packages are known to include an inductor which may be used to monitor the rotational speed of the motor shaft and can also be configured to detect lateral movement or vibration in the shaft as it rotates. The '953 patent further discloses a mechanical seal and a fluid exchange system that includes a series of passages that permit the movement of fluid between the motor and the pump.

The potting method of encapsulation of the electronic components can cause difficulties because the components may be subjected to high ambient pressure at a substantial vertical depth in the well. Such pressure is exerted on the exterior of the resin encapsulation and will be communicated to the electronic component through the encapsulation material. Such high pressure can cause damage or malfunction of the electronic components. Also, the reliability of the electronic components depends on the integrity of the encapsulation. If the encapsulation is not completely impermeable and without cracks or other imperfections, or if the encapsulation deteriorates (e.g., due to adverse conditions at depth in the wellbore, such as high temperature, vibration, high pressure, etc.) fluid may come into contact with one or more of the electronic components and disrupt correct functioning of the monitoring system.

Further, many electronic components which are preferable for use in the monitoring system may be qualified only for use in air.

Further, encapsulated electronic components cannot be serviced, for example, by replacing some components, or by repairing connections between components or between components and wiring. As a result, encapsulated electronic components in a monitoring system may require that certain expensive electronic components are scrapped if the monitoring system fails, when economic repair of the monitoring system may otherwise have been possible.

An inductor disclosed in the '953 patent to monitor shaft rotation speed and vibration is a large and costly component. For high performance, small diameter ESP systems, a preferred type of electric motor is a permanent magnet motor. Such motors are synchronous, that is, the motor speed is controlled by the frequency of the electrical power supply. Therefore, the inductor of such systems as shown in the '953 patent is not required to monitor rotational speed of the shaft when a permanent magnet motor is used in a pump system.

An example of a sensor system such as the one disclosed in the '953 patent is shown schematically in FIG. 2.

SUMMARY

Figure 1:
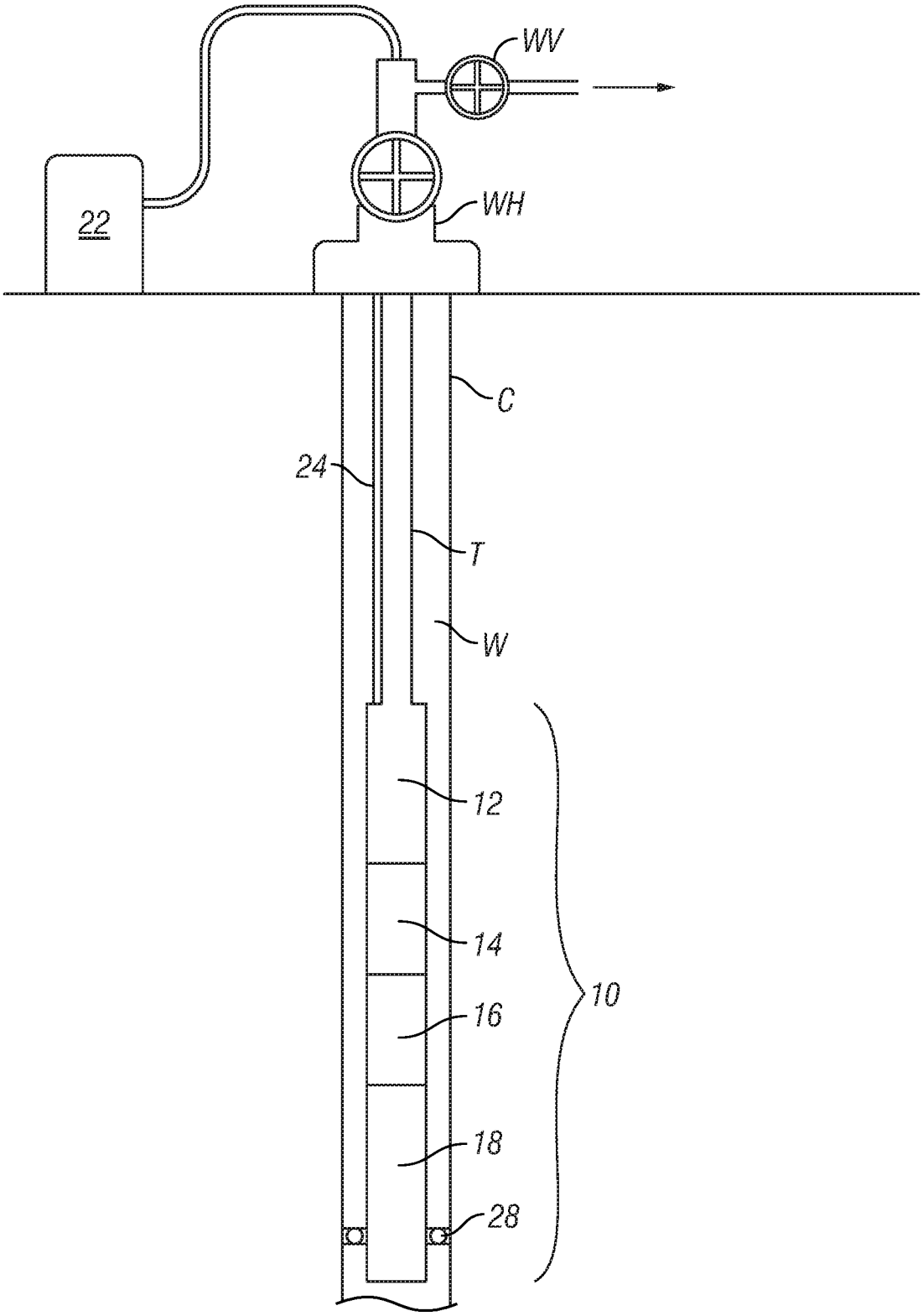
FIG. 1 shows a general arrangement of the pumping system installed in a well.
Figure 2:
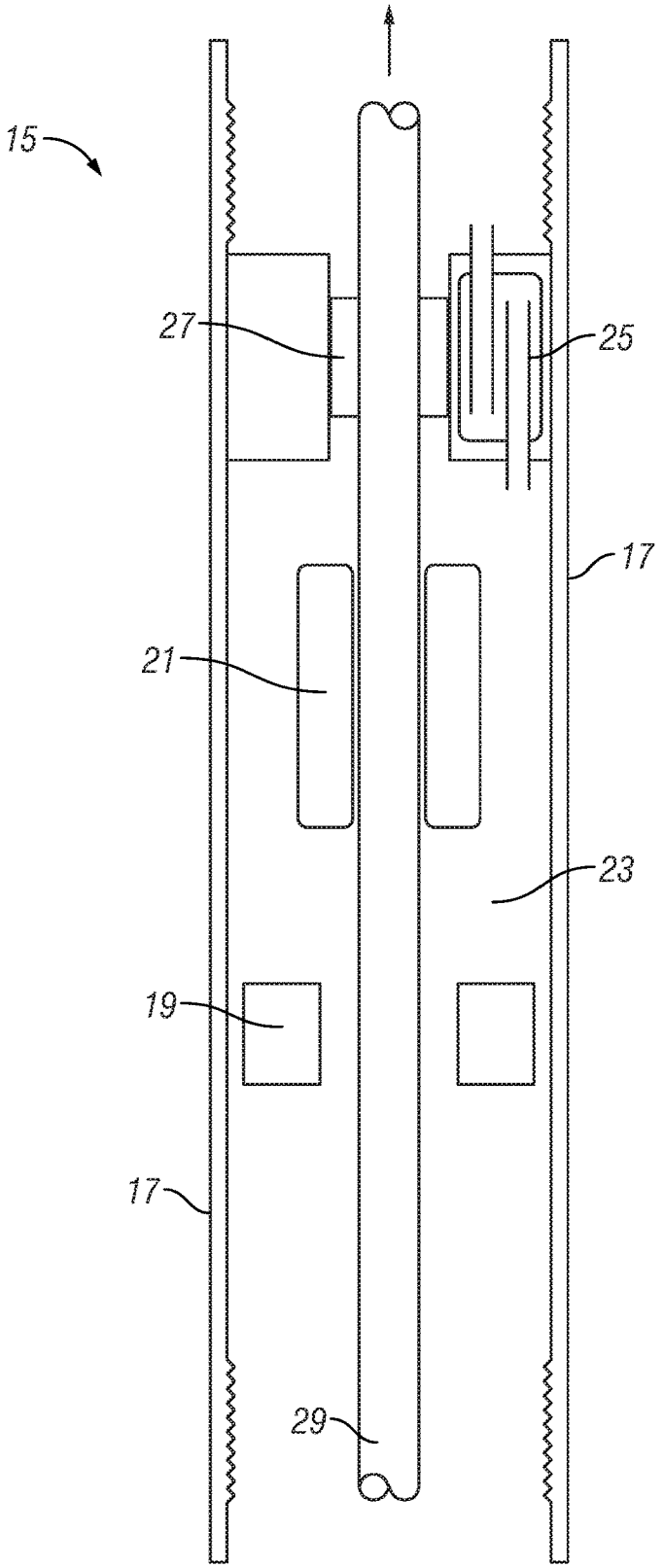
FIG. 2 (Prior Art)
FIG. 2 shows a longitudinal section of a monitoring package known in the art.

One aspect of the present disclosure relates to an inline monitoring package for use with a submersible pumping system. Such a submersible pumping system comprises a pump, a motor and a seal section disposed between the pump and the motor. The inline monitoring package comprises a housing having a first end configured for connection to one of the motor, the pump or the seal section. The housing has a second end configured for connection to another one of the motor, the pump or the seal section. The housing is disposed between any two of the pump, the motor and the seal section. A shaft is configured to transmit rotation from the motor to the pump. The housing comprises a chassis having a through bore and an end plug at each longitudinal end. The through bore has a diameter selected to enable free passage, through the bore, of the shaft and fluid associated with the shaft. The end plugs are sealingly engaged to an interior wall of the housing so as to define a sealed chamber inside the housing and external to the chassis between the end plugs. At least one electronic component is disposed in the sealed chamber.

Some embodiments additionally comprise a sensor array disposed in the sealed chamber.

Some embodiments additionally comprise a processor configured to process signals generated by the sensor array and to transmit representative data to surface-mounted control equipment by superimposing the generated signals over a motor power cable.

In some embodiments the motor power cable comprises a three-phase power cable and the signals are transmitted over a wye point connection to the motor.

In some embodiments the data signals are transmitted in frequency shift key format.

In some embodiments the sensor array comprises a motor temperature sensor configured to measure temperature of a motor lubricant and an external pressure sensor configured to measure pressure of fluid in a well adjacent to the inline monitoring package.

In some embodiments, the sealed chamber is filled with a gas or mixture of gasses at atmospheric pressure.

In some embodiments the sealed chamber is evacuated so as to maintain a vacuum therein.

In some embodiments the chassis is cooled by a fluid flow.

In some embodiments the fluid flow is delivered by the pump.

In some embodiments the chassis is extended axially beyond the sealed chamber and cooled by a fluid flow.

In some embodiments the motor comprises a permanent magnet electric motor.

A submersible pumping system according to another aspect of the present disclosure comprises a motor, a pump driven by the motor, a seal section disposed between the pump and the motor, a shaft configured to transmit rotation from the motor to the seal section and an inline monitoring package connected between the seal section and the motor. The inline monitoring package comprises at least one sensor and a signal communication device. The at least one sensor measures a parameter internal to or external to the submersible pumping system, and the communication device is contained within a sealed chamber defined within a housing forming part of the inline monitoring package.

In some embodiments the sealed chamber is annular and coaxial with the shaft.

In some embodiments either of or both a sensor and a signal communication device in the sealed chamber is/are mounted on a chassis which extends outside the sealed chamber and is cooled by a fluid flow.

In some embodiments further comprise a sensor array in the inline monitoring package.

In some embodiments the sensor array comprises a motor temperature sensor configured to directly measure the temperature of the motor lubricant or a stator and a pressure sensor configured to measure pressure of fluid in a well adjacent to the inline monitoring package.

In some embodiments the inline monitoring package additionally comprises a processor configured to process signals generated by the sensor array and to transmit representative data to surface-mounted control equipment by superimposing data signals over a power cable.

Some embodiments additionally comprising a three phase electrical power cable and the inline monitoring package additionally comprises an electrical connection with a corresponding wye point connection on the motor.

A submersible pumping system according to another aspect of the disclosure comprises a submersible electric motor, a surface-mounted motor controller, a power cable extending between the submersible electric motor and the surface-mounted motor controller, a pump driven by the electric motor and an inline monitoring package disposed between the pump and motor. The inline monitoring package includes a shaft for transmitting rotation from the electric motor to the pump. The monitoring package comprises a sensor array and a sealed chamber containing an electronic processor.

In some embodiments of pumping system the sensor array is configured to measure parameters internal to and external to the monitoring package and to transmit signals representative of the measured parameters. A processor is configured to process the signals generated by the sensor array into a selected data format for transmission over the power cable. The selected data format generated by the processor is coupled to a wye point connection in the motor or the power cable to transmit the output signals from the processor to the electric motor, the power cable and/or surface-mounted motor controller.

In some embodiments the selected format comprises frequency shift keying.

DETAILED DESCRIPTION

An example embodiment an inline monitoring package for use with a submersible pumping system according to the present disclosure is shown in elevational view in FIG. comprises an electric submersible pumping system 10 attached to a production tubing T in a subsurface well W. The electric submersible pumping system 10 and production tubing T are disposed in a well which is drilled through subsurface formations for the production of fluids such as water or petroleum. As used herein, the term "petroleum" refers broadly to all mineral hydrocarbons, such as crude oil, gas and combinations of oil and gas. The production tubing T mechanically connects the electric submersible pumping system 10 to a wellhead WH located at the surface. Fluid emerging from the well W may pass through a "wing" valve WV forming part of the wellhead W and thence delivered to suitable produced fluid processing equipment (not shown). Although the electric submersible pumping system 10 is designed to pump petroleum products, it will be understood that the present embodiment of a pumping system can also be used to move other fluids, for example and without limitation, water.

In some embodiments, the electric submersible pumping system 10 includes a combination of a pump 18, a motor 12 and a seal section 16. The motor 12 may be an electric motor that receives power from a surface-mounted motor control unit 22 transmitted over a power cable 24. When energized by the motor control unit 22, the motor 24 rotates a shaft (see FIG. 3) coupled to the motor 24 and the pump 18 that causes the pump 18 to operate. The pump 18 may be configured as a multistage turbomachine of the type commonly pumped by well fluid pumping systems. The seal section 16 shields the motor 12 from mechanical thrust produced by the pump 18 and provides for thermal expansion of motor lubricants during operation of the electric submersible pumping system 10. The seal section 16 also isolates the motor 12 from well fluids present in and moved by the pump 18. In some embodiments, such as the present embodiment, the pump 18 may be sealed against the interior of the tubing T, e.g., using an annular seal such as a packer 28, whereby discharge from the pump 18 is constrained to flow in the tubing T outside the electric submersible well pump system 10 upwardly toward the wellhead WH.

The electric submersible pumping system 10 may also include an inline monitoring package 14. In the present example embodiment, the inline monitoring package 14 may be connected within the electric submersible pumping system 10 longitudinally between the motor 12 and the seal section 16.

Figure 3:
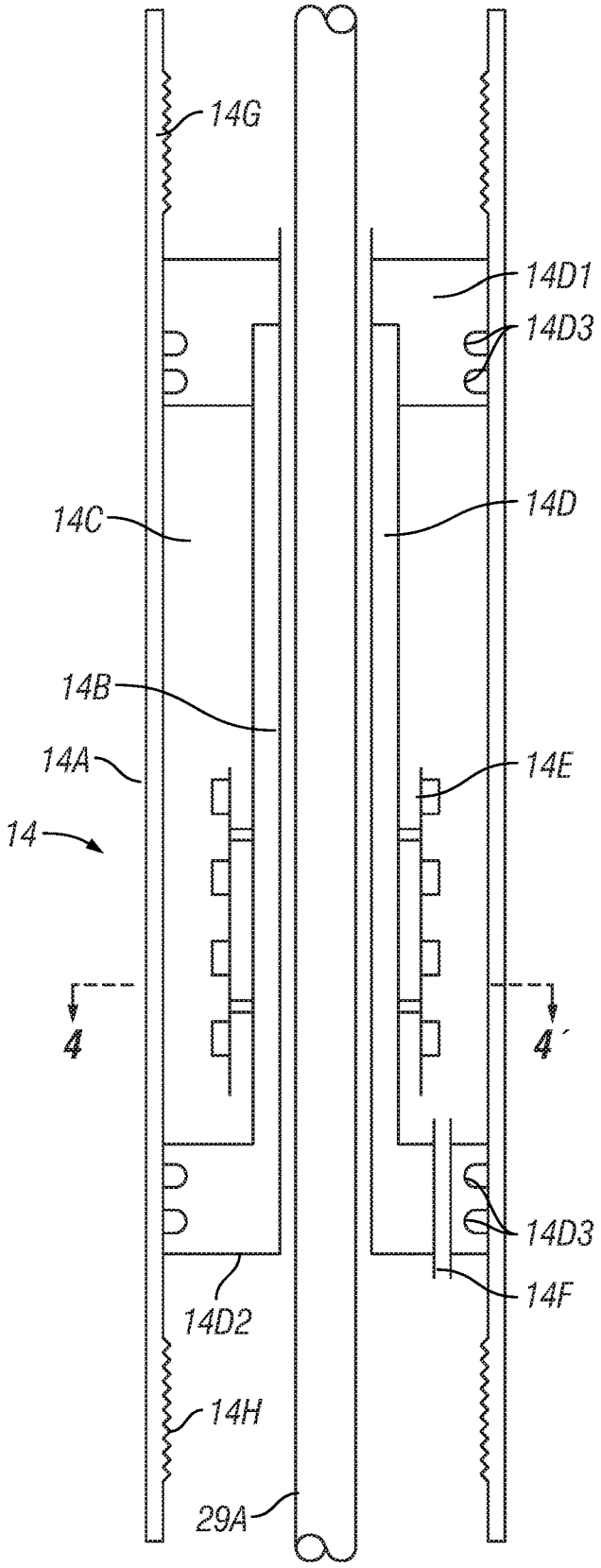
FIG. 3 shows a longitudinal section of a monitoring package according to the current disclosure.

Referring to FIG. 3, the inline monitoring package 14 may include a pressure resistant housing 14A having at each longitudinal end a first housing connector 14G, and a second housing connector 14H for coupling the housing 14A within the electric submersible pump system (10 in FIG. 1) as shown, for example in FIG. 1. A rotatable shaft 29A transfers rotation from the motor (12 in FIG. 1) to the pump (18 in FIG. 1). The rotatable shaft 29A passes through the interior of the inline monitoring package 14. The first housing connector 14G and second housing connector 14H, may be configured for locking threaded engagement with the housings of adjacent components in the electric submersible pump system (10 in FIG. 1), for example, the motor (12 in FIG. 1) and the seal section (16 in FIG. 1) as shown in FIG. 1.

The rotatable shaft 29A may be segmented and may therefore include torque transmission devices (not shown) disposed between adjacent segments, such as splined ends that are suitable for connection with couplers or directly with the adjacent shaft segment. Thus, the inline monitoring package 14 provides a feature to enable the rotatable shaft 29A or any segment thereof to pass through an interior of the pressure resistant housing 14A.

The inline monitoring package 14 is configured to communicate measurement data signals corresponding to measurements made by one or more sensors to the surface motor control unit (22 in FIG. 1) through the wye connection of the power cable (24 in FIG. 1) to the motor (12 in FIG. 1). Data signal communication may be established by encoding and superimposing suitably formatted signals (e.g., voltage variations) information through the power connection between the electric submersible pumping system (10 in FIG. 1) and the motor control unit (22 in FIG. 1). Suitable methods for communicating signals between a surface-mounted control unit and a three-phase electrical submersible pumping system are known in the art.

The inline monitoring package 14 includes a chassis 14D comprising a through bore 14B inside which the shaft 29A rotates. The 14B bore has a predetermined radial clearance around the shaft 29A, allowing free passage of fluid between the seal section (16 in FIG. 1) and the motor (12 in FIG. 1) as well as free longitudinal and rotational movement of the shaft 29A in the bore 14B.

Figure 4:
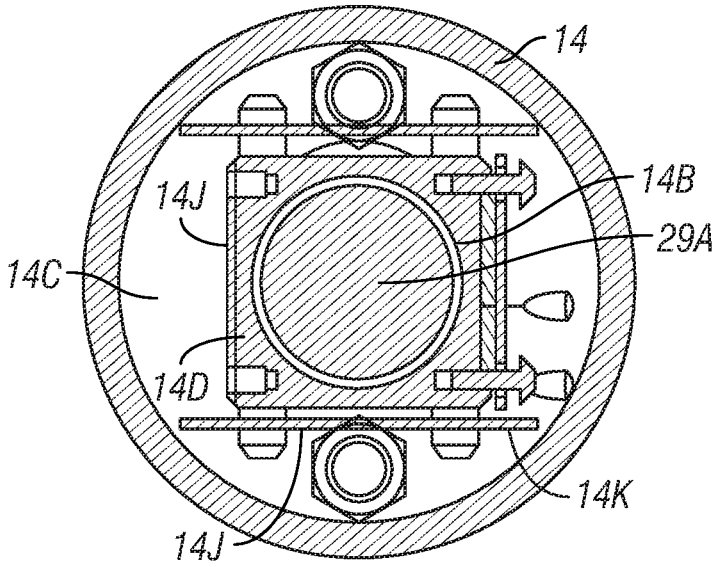
FIG. 4 shows a cross section of a monitoring package according to the current disclosure.

Referring to FIG. 4, in the present example embodiment, the chassis 14D may comprise one or more flat surfaces 14J on its exterior onto which one or more electronic components 14K may be mounted. The electronic components 14K may conveniently be assembled on one or more printed circuit boards which are mounted on such flat surface(s) 14J. The chassis 14D may be fabricated from one or more parts to facilitate manufacturing. In the case of a plurality of components, such components may be joined such that the through bore (14B in FIG. 3) is pressure tight with respect to exterior faces, for example, by electron beam welding. The dimensions of the chassis 14D may be selected to provide substantially sealed, interior space, e.g., chamber 14C between the exterior of the chassis 14D and the interior wall of the housing 14 such that the electronic components 14K may fit within the chamber 14C.

Referring once again to FIG. 3, the chassis 14D may include on its longitudinal ends an annular plug 14D1, 14D2 which conforms to the interior wall of the housing 14 and is sealingly coupled to the chassis 14D. The annular plugs 14D1, 14D2 may be made pressure tight, for example, by placing O rings 14D3 each disposed in a suitable retaining groove on the chassis 14D. In some embodiments, multiple O rings used may be used. Thus the pressure tight chamber 14C is created longitudinally between the annular plugs 14D1, 14D2 and exterior faces of the chassis 14D in which the one or more electronic components (14K in FIG. 4) may be mounted. In some embodiments, the chamber 14C may be filled with air, gas or gas mixtures substantially at atmospheric pressure. In some embodiments, the chamber 14C may be evacuated so as to maintain a vacuum therein.

The inline monitoring package 14 may comprise one or more microprocessors and a sensor array (shown collectively at 14K in FIG. 4) that are configured to acquire information about the external well environment and operational characteristics of the electric submersible pumping system (10 in FIG. 1). In the present example embodiment, the sensor array of the inline monitoring package may include (none of the sensors is shown separately in the drawings) a motor temperature sensor, an external pressure sensor and vibration sensors, e.g., accelerometers or velocity sensors, which may be mounted to detect vibration along more than one direction. Each of such sensors communicates measurement signals directly or indirectly to the processor(s), which processes the signals for transmission to the surface-mounted control unit (22 in FIG. 1). Such signal transmission may be made using the wye point of the power cable (24 in FIG. 1), e.g., by connection to the wye point on the motor (12 in FIG. 1). In one embodiment, the measurement signals may be transmitted in frequency shift key (FSK) format.

The motor temperature sensor provides a measurement of temperature of the fluid lubricants in the motor (12 in FIG. 1) and transmits a signal corresponding to the measured temperature to the circuit board. In one example embodiment, the motor temperature sensor may be configured as a resistance type sensor, for example, a resistance temperature detector (RTD). One example of this type is a platinum resistance thermometer (PRT). In other embodiments, a thermocouple may be used as the motor temperature sensor. RTDs are known to have higher accuracy and repeatability than thermocouples.

The external pressure sensor may be arranged to measure the pressure in fluid in the well (W in FIG. 1) adjacent the inline monitoring package (e.g., in the tubing T as shown in FIG. 1). In the case of a 'motor over pump' configuration of the pumping system for which the electric submersible pumping system described herein is particularly suitable, measuring fluid pressure in the production tubing (T in FIG. 1) can provide a measurement related to the pump (18 in FIG. 1) discharge pressure.

The inline monitoring package may include additional sensors and sensor arrays. For example and without limitation, sensors may be included which measure pump intake pressure, flow rates and pump discharge temperature. In one embodiment, the sensor array may include sensors to measure the following, for example and without limitation:

Pressure 1;
Pressure 2;
Temperature 1;
Temperature 2;
PCB (electronics 14K in FIG. 4) Temperature;
Vibration;
Voltage;
Current; and
Motor Winding Temperature.

Pressure tight feed through bulkhead connectors such as shown at 14F in FIG. 4 may be used for all electrical connections between the electronic components inside the chamber 14C and any component outside the chamber 14C. Such pressure tight feed through bulkhead connectors may be obtained, for example, from Kemlon Products, 1424 N. Main Street, Pearland, Tex. 77581, U.S.A.

The temperature of electronic components may be maintained within predetermined limits to ensure reliable operation and long service life. To maintain electronic component temperature within predetermined limits it may be desirable to provide a method of conducting heat from such component. One method is to provide a heat conduction path from the mounting of such electronic component to a fluid flow which will conduct the heat away.

The electronic components may be mounted on chassis 14D. The chassis 14D may be configured to extend axially beyond the chamber 14C such that a fluid is allowed to pass over and around the extension of the chassis 14D.

Figure 5:
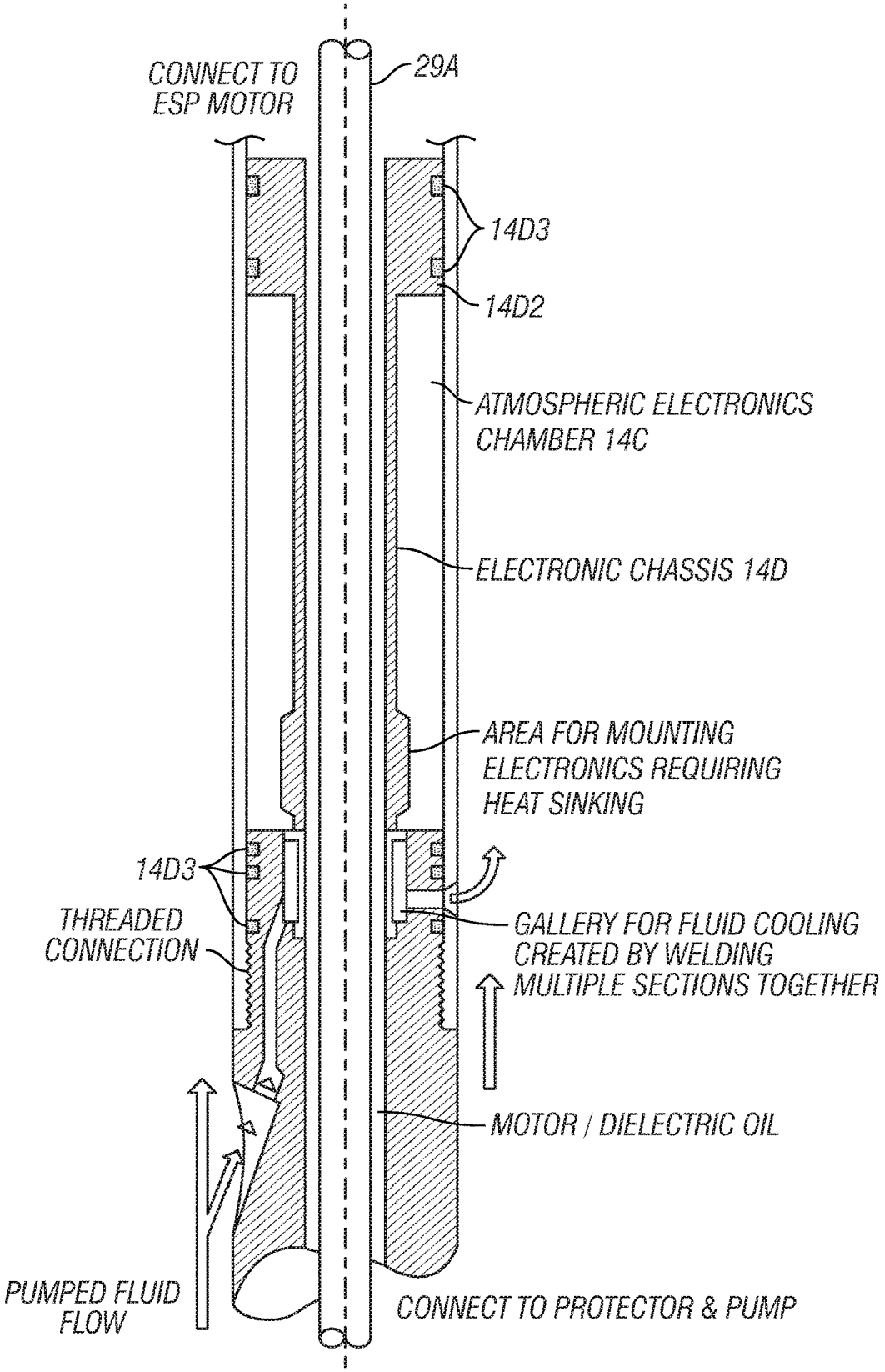
FIG. 5 shows a longitudinal section of a monitoring package according to the current disclosure in which a cooling system for electronic components is provided.

FIG. 5 shows an arrangement in which pumped fluid discharged by the electric submersible pumping system (10 in FIG. 1) passes over and around an extension of the chassis 14D, thereby extracting heat from the chassis 14D and cooling the electronic components in the chamber 14C.

The inline monitoring package in some embodiments may include thrust bearings, radial support bearings and additional mechanical seals (none shown separately). Thrust bearings may be used to control the axial displacement of the shaft (29A in FIG. 3). Radial support bearings may be used to control the lateral position of the shaft (29A in FIG. 3)

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures.

What is claimed is:

1. An inline monitoring package for use with a submersible pumping system having a pump, a motor and a seal section disposed between the pump and the motor, the inline monitoring package comprising:

a tubular housing having a first end configured for connection to one of the motor, the different one of the motor, the pump or the seal section, the housing disposed between any two of the pump, the motor and the seal section;

a shaft configured to transmit rotation from the motor to the pump;

a removable chassis having a through bore, the through bore having a diameter selected to enable free passage therethrough of the shaft and fluid associated with the shaft, the removable chassis having a first portion disposed inside the tubular housing, the first portion having end plugs sealingly engaged to an interior all of the tubular housing so as to define a sealed chamber inside the tubular housing and external to the chassis between the end plugs, the removable chassis having a second portion extending exterior to the housing and axially beyond the sealed chamber, the second portion comprising a flow path to allow fluid flow delivered by the pump to flow from exterior of the tubular housing through the second portion of the chassis into the first portion of the chassis to one of the end plugs to cool the sealed chamber and further to flow to the exterior of the tubular housing; and at least one electronic component disposed in the sealed chamber and attached to the chassis without potting.

2. The inline monitoring package of claim 1, further comprising a sensor array disposed in the sealed chamber.

3. The inline monitoring package of claim 2, further comprising a processor configured to process signals generated by the sensor array and to transmit representative data to surface-mounted control equipment by superimposing data signals generated by the processor over a motor power cable electrically connected to the motor.

4. The inline monitoring package of claim 3 wherein the motor power cable comprises a three-phase power cable and the signals are transmitted over a wye point connection to the motor.

5. The inline monitoring package of claim 3 wherein the data signals are transmitted in frequency shift key format.

6. The inline monitoring package of claim 2, wherein the sensor array comprises a motor temperature sensor configured to measure temperature of a motor lubricant; and an external pressure sensor configured to measure pressure of fluid in a well adjacent to the inline monitoring package.

7. The inline monitoring package of claim 1, wherein the sealed chamber is filled with a gas or mixture of gasses at atmospheric pressure.

8. The inline monitoring package of claim 1, wherein the sealed chamber is evacuated so as to maintain a vacuum therein.

9. The inline monitoring package of claim 1 wherein the motor comprises a permanent magnet electric motor.

10. A submersible pumping system comprising:

a motor;

a pump driven by the motor;

a seal section disposed between the pump and the motor;

a shaft configured to transmit rotation from the motor to the seal section and;

an inline monitoring package connected between the seal section and the motor, wherein the inline monitoring package comprises at least one sensor and a signal communication device, wherein the at least one sensor measures a parameter internal to or external to the submersible pumping system, and the communication device is contained within a sealed chamber defined within a tubular housing forming part of the inline monitoring package;

wherein the housing comprises a first end configured for connection to one of the motor, the pump or the seal section, the housing having a second end configured for connection to a different one of the motor, the pump or the seal section, the housing disposed between any two of the pump, the motor and the seal section; and a removable chassis having a through bore, the through bore having a diameter selected to enable free passage therethrough of the shaft and fluid associated with the shaft, the removable chassis having a first portion disposed inside the tubular housing, the first portion having end plugs sealingly engaged to an interior wall of the tubular housing so as to define a sealed chamber inside the tubular housing and external to the chassis between the end plugs, the removable chassis having a second portion extending exterior to the housing and axially beyond the sealed chamber, the second portion comprising a flow path to allow fluid flow delivered by the pump to flow from exterior of the tubular housing through the second portion of the chassis into the first portion of the chassis to one of the end plugs to cool the sealed chamber and further to flow to the exterior of the tubular housing;

the at least one sensor and a signal communication device attached to the chassis without potting.

11. The submersible pumping system of claim 10, wherein the sealed chamber is annular and coaxial with the shaft.

12. The submersible pumping system of claim 11, wherein at least one of a sensor and a signal communication device in the sealed chamber is mounted on a chassis which extends outside the sealed chamber and is cooled by a fluid flow.

13. The submersible pumping system of claim 10 wherein the inline monitoring package further comprises a processor configured to process signals generated by the sensor array and to transmit representative data to surface-mounted control equipment by superimposing data signals over a power cable.

14. The submersible pumping system of claim 10 further comprising a three phase electrical power cable connected to the power cable in wye connection, wherein the inline monitoring package further comprises an electrical connection with a corresponding wye point connection on the motor.

15. A submersible pumping system, comprising:

a submersible electric motor;

a surface-mounted motor controller;

a power cable extending between the submersible electric motor and the surface-mounted motor controller;

a pump driven by the electric motor; and a monitoring package disposed between the pump and the submersible electric motor, wherein the monitoring package includes a shaft for transmitting rotation from the submersible electric motor to the pump, the monitoring package further comprises a sensor array and a sealed chamber containing an electronic processor; wherein a tubular housing comprising a first end configured for connection to one of the motor, the pump or a seal section, the housing having a second end configured for connection to a different one of the motor, the pump or the seal section, the housing disposed between any two of the pump, the motor and the seal section; and a removable chassis having a through bore, the through bore having a diameter selected to enable free passage therethrough of the shaft and fluid associated with the shaft, the removable chassis having a first portion disposed inside the tubular housing, the first portion having end plugs sealingly engaged to an interior wall of the tubular housing so as to define a sealed chamber inside the tubular housing and external to the chassis between the end plugs, the removable chassis having a second portion extending exterior to the housing and axially beyond the sealed chamber, the second portion comprising a flow path to allow fluid flow delivered by the pump to flow from exterior of the tubular housing through the second portion of the chassis into the first portion of the chassis to one of the end plugs to cool the sealed chamber and further to flow to the exterior of the tubular housing;

wherein the sensor array is attached to the chassis without potting.

16. The submersible pumping system of claim 15, wherein:

the sensor array is configured to measure parameters internal to and external to the monitoring package and to generate signals representative of the measured parameters;

a processor configured to process the signals generated by the sensor array into a selected data format for transmission over the power cable; and wherein signals in the selected data format from the processor are coupled to a wye point connection to the motor or to the power cable to transmit the signals from the processor to the electric motor, power cable and surface-mounted motor controller.

17. The submersible pumping system of claim 16 wherein the selected data format comprises frequency shift keying.

* * * * *